US006749695B2

(12) United States Patent
Martis et al.

(10) Patent No.: US 6,749,695 B2
(45) Date of Patent: Jun. 15, 2004

(54) FE-BASED AMORPHOUS METAL ALLOY HAVING A LINEAR BH LOOP

(76) Inventors: Ronald J. Martis, 34 Fairway Dr., East Hanover, NJ (US) 07936; Ryusuke Hasegawa, 29 Hill St., Morristown, NJ (US) 07960

( * ) Notice: Subject to any disclaimer, the term of this patent is extended or adjusted under 35 U.S.C. 154(b) by 40 days.

(21) Appl. No.: 10/071,990

(22) Filed: Feb. 8, 2002

(65) Prior Publication Data

US 2003/0150528 A1 Aug. 14, 2003

(51) Int. Cl.[7] ..... H01F 1/153
(52) U.S. Cl. ..... 148/304; 148/403
(58) Field of Search ..... 148/304, 403, 148/108

(56) References Cited

U.S. PATENT DOCUMENTS

| | | | | |
|---|---|---|---|---|
| 3,856,513 A | | 12/1974 | Chen et al. | 75/122 |
| 4,409,041 A | | 10/1983 | Datta et al. | 148/31.55 |
| 4,473,413 A | | 9/1984 | Nathasingh et al. | 148/31.5 |
| 4,812,181 A | | 3/1989 | Hilzinger et al. | 148/121 |
| 5,110,378 A | | 5/1992 | Hasegawa et al. | 148/304 |
| 5,200,002 A | | 4/1993 | Hilzinger | 148/304 |
| 5,284,528 A | | 2/1994 | Hasegawa et al. | 148/304 |
| 5,871,593 A | | 2/1999 | Fish et al. | 148/304 |
| 6,018,296 A | * | 1/2000 | Herzer | 148/304 |
| 6,144,279 A | | 11/2000 | Collins et al. | 336/178 |

FOREIGN PATENT DOCUMENTS

WO WO-98/28639 A2 * 7/1998

* cited by examiner

*Primary Examiner*—George Wyszomierski
(74) *Attorney, Agent, or Firm*—Ernest D. Buff And Associates, LLC; Ernest D. Buff; Gondon E. Fish

(57) ABSTRACT

A metallic glass alloy ribbon consists essentially of about 70 to 87 atom percent iron. Up to about 20 atom percent of the iron is replaced by cobalt and up to about 3 atom percent of the iron is replaced by nickel, manganese, vanadium, titanium or molybdenum. About 13–30 atom percent of the element balance comprises a member selected from the group consisting of boron, silicon and carbon. The alloy is heat-treated at a sufficient temperature to achieve stress relief. A magnetic field applied during the heat-treatment causes the magnetization to point away from the ribbon's predetermined easy magnetization direction. The metallic glass exhibits linear DC BH loops with low ac losses. As such they are especially well suited for use in current/voltage transformers.

10 Claims, 3 Drawing Sheets

FE-BASED AMORPHOUS METAL ALLOY HAVING A LINEAR BH LOOP

RELATED U.S. APPLICATION DATA

This application is related to U. S. patent application Ser. No. 10/071,682 filed Feb. 8, 2002, for "Current Transformer Having An Amorphous Fe-Based Core" and to U.S. patent application Ser. No. 10/071,368 filed Feb. 8, 2002, for "Filter Circuit Having An Fe-Based Core," both of which are assigned to the assignee of the present application.

BACKGROUND OF THE INVENTION

1. Field of the Invention

The present invention relates to a ferromagnetic amorphous metal alloy; and more particularly to a process for annealing the alloy so that its magnetization curve with respect to applied field becomes linear.

2. Description of the Prior Art

Metallic glasses are metastable materials lacking any long-range order. X-ray diffraction scans of glassy metal alloys show only a diffuse halo similar to that observed for inorganic oxide glasses. Metallic glasses (amorphous metal alloys) have been disclosed in U.S. Pat. No. 3,856,513. These alloys include compositions having the formula $M_aY_bZ_c$, where M is a metal selected from the group consisting of iron, nickel, cobalt, vanadium and chromium, y is an element selected from the group consisting of phosphorous, boron and carbon and Z is an element selected from the group consisting of aluminum, silicon, tin, germanium, indium, antimony and beryllium, "a" ranges from about 60 to 90 atom percent, "b" ranges from about 10 to 30 atom percent and "c" ranges from about 0.1 to 15 atom percent. Also disclosed are metallic glass wires having the formula $T_IX_j$, where T is at least one transition metal and X is an element selected from the group consisting of phosphorus, boron, carbon, aluminum, silicon, tin, germanium, indium, beryllium and antimony, "I" ranges from about 70 to 87 atom percent and "j" ranges from 13 to 30 atom percent. Such materials are conveniently prepared by rapid quenching from a melt at temperatures of the order of $1\times10^{6\circ}$ C./sec. using processing techniques that are well known in the art.

These disclosures also mention unusual or unique magnetic properties for many metallic glasses, which fall within the scope of the broad claims. However, metallic glasses possessing a combination of linear BH loop and low losses are required for specific applications such as current/voltage transformers.

A linear B-H characteristic is generally obtained in a soft magnetic material wherein the material's magnetically easy axis lies perpendicular to the direction of the magnetic excitation. In such a material, the external magnetic field H tends to tilt the average direction of the magnetic flux B, so that the measured quantity B is proportional to H. Most magnetic materials, however, have nonlinear B-H characteristics. As a result, the ideal linear B-H characteristics are not easily achieved. Any deviation from an ideal B-H linearity introduces corresponding deviations in the magnetic response to the externally applied field H.

A classical example of magnetic materials showing linear B-H characteristics is a cold rolled 50% Fe—Ni alloy called Isoperm. Among amorphous magnetic alloys, heat-treated Co-rich alloys have been known to provide linear B-H characteristics and are currently used as the magnetic core materials in current transformers. The Co-rich amorphous alloys in general have saturation inductions lower than about 10 kG or 1 Tesla, which limits the maximum field levels to be applied. Moreover, these alloys are expensive owing to the large amount of Co required to form the alloys. Clearly needed are inexpensive alloys having saturation inductions higher than 10 kG and exhibiting linear B-H characteristics.

SUMMARY OF THE INVENTION

The present invention provides a method for enhancing the magnetic properties of a metallic glass alloy having in combination a linear BH loop and low core loss. Generally stated, the metallic glasses consist essentially of about 70–87 atom percent iron with up to about 20 atom percent of iron and nickel being replaced by cobalt; up to about 3 atom percent of iron being replaced by at least one of manganese, vanadium, titanium or molybdenum, and about 13–30 atom percent of the elements being selected from the group consisting of boron, silicon and carbon. The method comprises the step of heat-treating the metallic glass alloy for a time and at a temperature sufficient to achieve stress relief and magnetization orientation away from the ribbon axis. In one aspect of the invention, the method is carried out in the absence of a magnetic field. Another aspect of the invention involves the step of carrying out the method in the presence of a magnetic field applied in a direction perpendicular to the ribbon axis.

Metallic glass alloys treated in accordance with the method of this invention are especially suitable for use in devices requiring linear response to magnetic fields, such as current/voltage transformers for metering applications.

BRIEF DESCRIPTION OF THE DRAWINGS

The invention will be more fully understood and further advantages will become apparent when reference is had to the following detailed description and the accompanying drawings, wherein like reference numerals denote similar elements throughout the several views and in which.

DETAILED DESCRIPTION OF THE INVENTION

Figure 1:
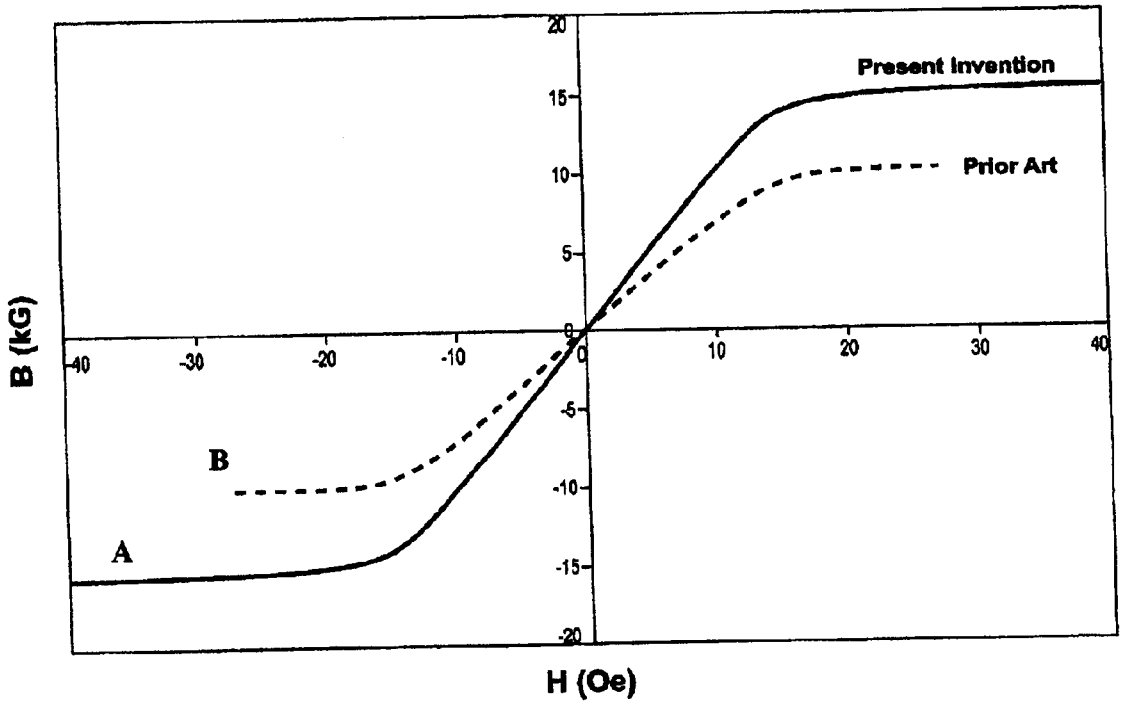
FIG. 1 is a graph depicting the B-H characteristics of an amorphous Fe—B—Si based alloy of the present invention and a prior art amorphous Co-based alloy.

Heat treatment of the metallic glass alloys of the invention enhances the magnetic properties thereof. More specifically, upon heat treatment in accordance with the invention, the metallic glass alloys evidence a superior combination of the following properties: linear BH loop and low ac core loss. The alloys consist essentially of about 70 to 87 atom percent iron with cobalt replacing up to about 20 atom percent of the iron and nickel present; at least one of manganese, vanadium, titanium or molybdenum replacing up to about 3 atom percent of the iron, and the balance being selected from the group consisting of boron, silicon and carbon. The heat-treating process comprises the steps of (a) heating the alloy to a temperature sufficient to achieve stress relief, (b) applying a magnetic field to the alloy in a direction perpendicular to the ribbon axis, at least during the cooling step. The cooling step is typically carried out at a cooling rate of about −0.5° C./min to −100° C./min and preferably at a rate of about −0.5° C./min to −20° C./min. A heat treatment carried out in the absence of an applied field generally results in non-linear BH loops. However, partial crystallization creates a local magnetic field, which acts as though it is an applied field. This, in turn, results in a linear B-H behavior for a small magnetic excitation. When this takes place, the transverse field applied along the direction perpendicular to the ribbon axis becomes optional.

It is generally found that the process of forming metallic glass alloys results in cast-in stresses. The process of fabricating magnetic implements from metallic glass alloys may introduce further stresses. Hence, it is preferred that the metallic glass alloy be heated to a temperature and held for a time sufficient to relieve these stresses. Application of a magnetic field during that heat treatment enhances the formation of magnetic anisotropy in the direction along which the field is applied. The field is especially effective when the alloy is at a temperature that is (i) near the Curie temperature or up to 50° C. below it, and (ii) high enough to allow atomic diffusion or rearrangement of its constituents.

The magnetic field is applied in a transverse direction, defined as the direction perpendicular to that of magnetic excitation during operation. When the magnetic implement is a wound toroid, a continuous ribbon of metallic glass is wound upon itself. For such a toroid, the transverse direction is parallel to the axis of the toroid. A transverse magnetic field is conveniently applied by placing the toroid coaxially between the poles either of permanent magnets or of an electromagnet or by placing the toroid coaxially inside a solenoid energized by a suitable electric current.

The temperature (T) and holding time(t) of the preferred heat treatment of the metallic glasses of the present invention are dependent on the composition of the alloy. T is typically about 300°–450° C. and t is 1–10 hours.

The method for enhancing the magnetic properties of the alloys of the present invention is further characterized by the direction of the magnetic field applied during the heat treatment.

The preferred method comprises carrying out the heat treatment in the presence of a transverse field, and, optionally, in the presence of a mixed magnetic field having a first component applied in the transverse direction and a second component applied in the longitudinal direction. When carrying out a heat treatment in the presence of a transverse field, the field strength is in the range of 50–2,000 Oe (4,000–160,000 A/m). The resulting material is characterized by a linear BH loop and a low core loss. Magnetic cores fabricated with such annealed material are especially suited for applications such as current/potential transformers that measure intensity of an ac field. The constant permeability or linear BH loop allows a device such as a current/potential transformer to provide a linear output over a wide range of applied fields.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES

Example 1

Iron-Based Amorphous Alloys

Amorphous iron-based alloys of the present invention having thicknesses of about 15 to 30 $\mu$m were cast by rapid solidification technique. Magnetic toroids were made by winding the ribbon or slit ribbon and were heat treated in a box oven. Transverse magnetic fields were produced either by placing the toroids axially between the poles of two permanent magnets or by placing the toroid within a solenoid carrying the requisite electric current.

Figure 2:
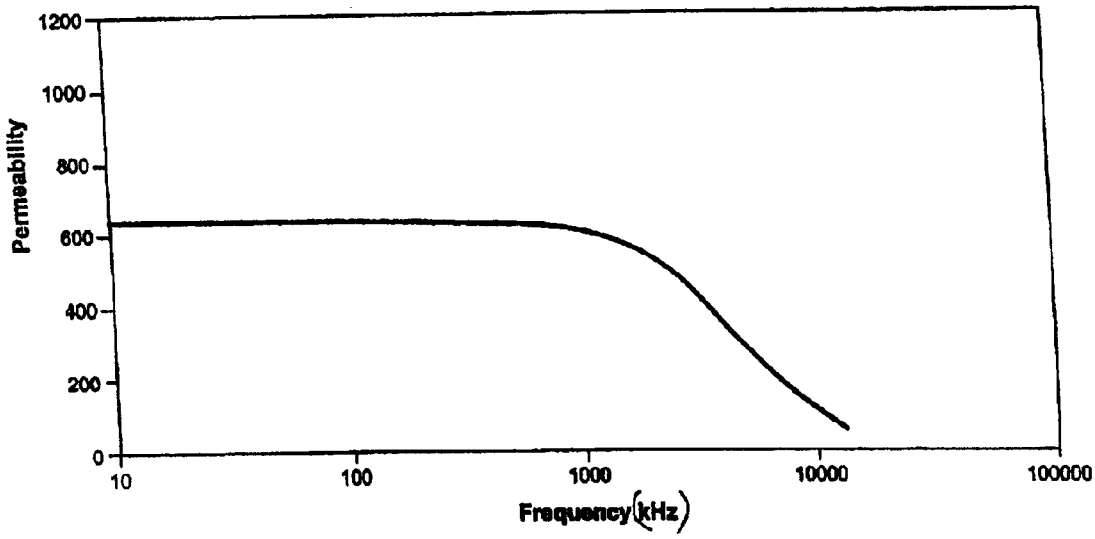
FIG. 2 is a graph depicting the permeability of an amorphous Fe-based alloy of FIG. 1 as a function of frequency.

An iron-based amorphous alloy ribbon was wound in a toroidal shape to form a magnetic toroid. The toroid was then heat-treated in an oven with a magnetic field along the toroid axis direction. The toroid was then examined using a commercially available BH hysteresigraph to ascertain a linear B-H relationship, where B and H stand for magnetic induction and magnetic field, respectively. FIG. 1 compares the B-H characteristics of an amorphous Fe-based core prepared in accordance with the present invention and a prior art Co-based amorphous alloy toroid. The core of the present invention was heat-treated at 400° C. for 10 hours with a magnetic field of 16,000 A/m applied perpendicularly to the toroid's circumference direction. The B-H behavior of the core of the present invention is linear within an applied field ranging from about −15 Oe (−1,200 A/m) and +15 Oe (+1,200 A/m) with an accompanying magnetic induction or flux change from −12 kG (−1.2 T) to +12 kG (+1.2 T). The linear B-H region of a prior art Co-based core on the other hand is limited to a flux change from about −7 kG (−0.7 T) to +7 kG (+0.7 T), which limits the magnetic response capability. A linear B-H characteristic means a linear magnetic permeability, which is defined by B/H. FIG. 2 shows that the permeability of an amorphous Fe-based alloy of the present invention is constant up to a frequency of about 1000 kHz or 1 MHz. This means that the magnetic response of the Fe-based amorphous alloys of the present invention can be maintained at a certain level throughout the entire frequency range up to about 1000 kHz.

Figure 3:
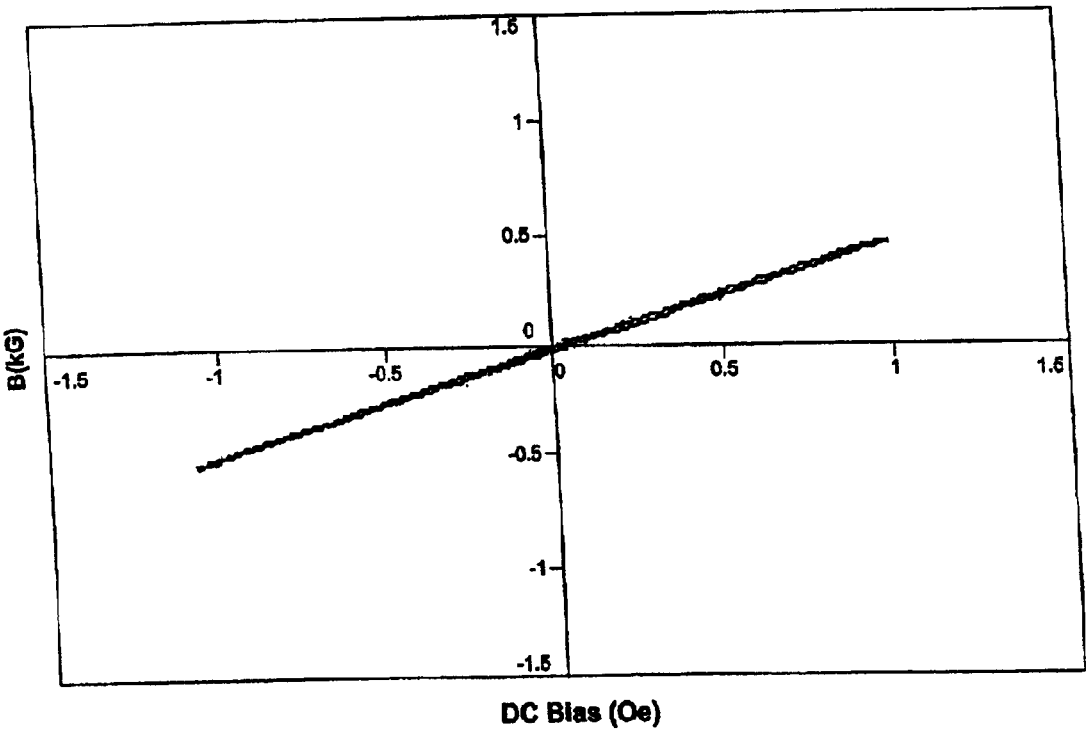
FIG. 3 is a graph depicting B-H characteristics of an amorphous Fe-based alloy of the present invention heat-treated at 420° C. for 6.5 hours without applied field.

A linear B-H behavior was found for an external field of less than about 3 Oe (240 A/m) in a partially crystallized Fe-based amorphous alloy core as shown in FIG. 3. In this case magnetic field during heat-treatment was optional. This core provides a current transformer for sensing low current levels.

Typical examples of the dc permeabilities of the Fe-based amorphous alloys are listed in Table I, where Fe—B—Si based toroidally-shaped sample cores had a dimension of OD=13.0 mm, ID=9.5 mm and Height=4.8 mm and Fe—B—Si—C based cores had a dimension of OD=25.5 mm, ID=16.5 mm and Height=9.5 mm. The saturation inductions of the Fe—B—Si and Fe—B—Si—C based alloys are 1.56 and 1.60 T, respectively.

TABLE I

| Alloy | Anneal Temp (° C.) | Anneal Time (hours) | Transverse Field (A/m) | DC Permeability |
|---|---|---|---|---|
| METGLAS ® 2605SA1 (Fe-B-Si) | 410 | 6.5 | 0 | 460 |
| METGLAS ® 2605SA1 (Fe-B-Si) | 420 | 8 | 20,000 | 910 |
| METGLAS ® 2605SC (Fe-B-Si-C) | 400 | 5 | 20,000 | 3,650 |
| METGLAS ® 2605SC (Fe-B-Si-C) | 390 | 8 | 20,000 | 5,300 |

Example 2

Sample Preparation

Amorphous alloys were rapidly quenched from the melt with a cooling rate of approximately $10^6$ K/s following the techniques taught by Chen et al in U. S. Pat. No. 3,856,513.

The resulting ribbons, typically 10 to 30 $\mu$m thick and about 1 cm to about 20 cm wide, were determined to be free of significant crystallinity by x-ray diffractometry (using Cu—K$\alpha$ radiation) and differential scanning calorimetry. Amorphous alloys in ribbon form were strong, shiny, hard and ductile.

The ribbons thus produced were slit into narrower ribbons which in turn were wound in toroidal shapes with different dimensions. The toroids were heat-treated with or without a magnetic field in an oven with temperatures between 300 and 450° C. When a magnetic field was applied during heat-treatment, its direction was along the transverse direction of toroid's circumference direction. Typical field strengths were 50–2,000 Oe (4,000–160,000 A/m).

Magnetic Measurements

A magnetic toroid prepared in accordance with Example 2 was tested in a conventional BH hysteresigraph to obtain B-H characteristics. The magnetic permeability defined as B/H was measured on the toroid as a function of frequency, which resulted in the curve shown in FIG. 2.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. An amorphous iron-based alloy having a composition consisting essentially of about 70–87 atom percent iron, up to about 20 atom percent of the iron being optionally replaced by cobalt and up to about 3 atom percent of the iron being optionally replaced by nickel, manganese, vanadium, titanium or molybdenum, the balance of elements present comprising a member selected from the group consisting of boron, silicon and carbon, said alloy being heat-treated to induce a linear BH characteristic within an applied field ranging from about −15 Oe to +15 Oe and low magnetic loss.

2. A heat-treated amorphous iron-based alloy as recited by claim 1, having a saturation magnetic induction exceeding about 10 kG, or 1 Tesla.

3. An amorphous iron-based alloy as recited by claim 1, said alloy having the form of a strip having a predetermined easy magnetization direction and having been heat-treated in a magnetic field, the magnitude of said magnetic field ranging from about 50 Oe (4,000 A/m) to about 2,000 Oe (160,000 A/m), and said field having been applied perpendicular to the predetermined easy magnetization direction of said strip.

4. An amorphous iron-based alloy as recited by claim 1, said alloy having been heat-treated at a temperature near the Curie temperature of the alloy.

5. An amorphous iron-based alloy as recited by claim 4, said alloy having been heat-treated at a temperature high enough to allow atomic diffusion or rearrangement of its constituents.

6. An amorphous iron-based alloy having a composition consisting essentially of about 70–87 atom percent iron, up to about 20 atom percent of the iron being optionally replaced by cobalt and up to about 3 atom percent of the iron being optionally replaced by nickel, manganese, vanadium, titanium or molybdenum, the balance of elements present comprising a member selected from the group consisting of boron, silicon and carbon, said alloy being heat-treated in the presence of a magnetic field to induce a linear BH characteristic within an applied field ranging from about −15 Oe to +15 Oe and low magnetic loss.

7. A heat-treated amorphous iron-based alloy as recited by claim 6, having a saturation magnetic induction exceeding about 10 kG, or 1 Tesla.

8. An amorphous iron-based alloy as recited by claim 6, said alloy having the form of a strip having a predetermined easy magnetization direction and said magnetic field having a magnitude ranging from about 50 Oe (4,000 A/m) to about 2,000 Oe (160,000 A/m), and having been applied perpendicular to the predetermined easy magnetization direction of said strip.

9. An amorphous iron-based alloy as recited by claim 6, said alloy having been heat-treated at a temperature near the Curie temperature of the alloy.

10. An amorphous iron-based alloy as recited by claim 9, said alloy having been heat-treated at a temperature high enough to allow atomic diffusion or rearrangement of its constituents.

* * * * *